US005273225A

United States Patent [19]

Backhaus

[11] Patent Number: 5,273,225

[45] Date of Patent: Dec. 28, 1993

[54] APPARATUS FOR DELIVERING CARRIER-MOUNTED COPS TO THE WINDING HEADS OF A BOBBIN WINDING MACHINE

[75] Inventor: Jürgen Backhaus, Wegberg, Fed. Rep. of Germany

[73] Assignee: W. Schlafhorst AG & Co., Moenchengladbach, Fed. Rep. of Germany

[21] Appl. No.: 905,723

[22] Filed: Jun. 29, 1992

[30] Foreign Application Priority Data

Apr. 1, 1992 [DE] Fed. Rep. of Germany ..... 4210815

[51] Int. Cl.[5] ..... B65H 67/06

[52] U.S. Cl. ..... 242/35.5 A

[58] Field of Search ..... 242/35.5 A, 35.5 R, 242/18 R

[56] References Cited

U.S. PATENT DOCUMENTS

| | | | |
|---|---|---|---|
| 4,566,644 | 1/1986 | Kiriake | 242/35.5 A |
| 5,056,725 | 10/1991 | Wirtz et al. | 242/35.5 A |
| 5,078,329 | 1/1992 | Grecksch et l. | 242/35.5 A |
| 5,092,531 | 3/1992 | Grecksch et al. | 242/35.5 A |

FOREIGN PATENT DOCUMENTS

| | | |
|---|---|---|
| 3338857A1 | 5/1984 | Fed. Rep. of Germany . |
| 3919542A1 | 12/1990 | Fed. Rep. of Germany . |
| 4011797A1 | 12/1990 | Fed. Rep. of Germany . |

*Primary Examiner*—Stanley N. Gilreath
*Attorney, Agent, or Firm*—Shefte, Pinckney & Sawyer

[57] ABSTRACT

An apparatus for delivering cops mounted upright on caddies to the winding heads of an automatic bobbin winding machine assures a sufficient supply of cops to all winding heads along the entire winding machine, even in the case of relatively short cop times, by locating infeed positions for the caddies at spacings along a distributing conveyor common to all winding heads such that a first plurality $n_1$ of operating winding heads are located to a front side of a first infeed position, a second plurality $n_2$ of operating winding heads are located to the opposite rear side of the last infeed position, and a third plurality k of operating winding heads are located between such infeed positions, with $n_1 \geqq 4$, $n_2 \geqq 4$ and $k \leqq n_1 + n_2 + 3$. The distributing conveyor belt is driven alternatingly in opposite directions to distribute the cop-mounted caddies.

12 Claims, 5 Drawing Sheets

APPARATUS FOR DELIVERING CARRIER-MOUNTED COPS TO THE WINDING HEADS OF A BOBBIN WINDING MACHINE

BACKGROUND OF THE INVENTION

The present invention relates generally to bobbin winding machines and more particularly to apparatus for conveying cops mounted upstanding on carriers such as caddies or peg trays to multiple winding heads of a bobbin winding machine.

Japanese Parent Document JP-AS 49-12128 teaches an automatic bobbin winding machine wherein a plurality of winding heads are permanently arranged adjacent to each other and a conveyor belt extends along the bobbin winding machine along a guide track for transporting peg trays or like carriers to the winding heads. Cops are inserted onto the peg trays in upstanding disposition and remain on the peg trays during transportation to the winding heads, the unwinding operation thereat, and also as empty tubes during return conveyance away from the winding heads. Storage stretches for the peg trays are located in front of the winding heads. The conveyor belt extending along the bobbin winding machine has the function of delivering the peg trays to all winding heads. The delivery of the peg trays to the storage stretches of the winding heads takes place by means of controllable loading devices. The peg trays are delivered to the conveyor belt only as needed.

German Published Patent Application DE-OS 33 08 172 also teaches a bobbin winding machine which exhibits the essential features of the bobbin winding machine already described. However, no separately controllable loading devices are present but rather fixed guide plates deflect all individual carriers arriving on the cop carrier conveyor belt in the direction of magazines associated with the winding heads of the machine. These guide plates, in conjunction with the shaping of delivery stretches extending to the winding heads, permit a deflection of caddies or peg trays only in one direction of travel along the cop carrier conveyor belt. For this reason, in view of the fact that caddies or peg trays are regularly delivered to the conveyor belt, not merely when there is a particular determined requirement of the winding heads, care must be taken that peg trays or caddies arriving at the end of the conveyor belt and not received by the delivery stretches to the winding heads do not accumulate or back up, which could ultimately result in a blocking of the entire delivery of cops to the winding heads. To this end, an additional return track parallel to the cop carrier conveyor belt is provided in the apparatus disclosed in German Patent Application DE-OS 33 08 172 for returning the excess caddies or peg trays to the entrance of the carrier conveyor belt.

German Patent DE 38 43 554 A1 teaches an apparatus for delivering caddies or peg trays to the winding heads of a bobbin winding machine wherein a distributing stretch is formed by a reversibly drivable conveyor belt. It is also possible with this apparatus to effect a distribution of the caddies or peg trays mounted with cops to the winding heads without additional switchable means. The reversing operation of the conveyor belt of the distributing stretch assures a distribution of the caddies or peg trays without a problematic accumulation and eliminates a return track.

In the distribution of caddies or peg trays to the winding heads in the apparatus described in German Patent Application DE-OS 33 08 172, an undersupplying of the winding heads located at one end of the distributing stretch can occur, especially if short rewinding times of the cops necessitate a frequent cop replacement. Cops arriving at the entrance end of this distributing stretch ar therefore taken up relatively rapidly by the closer winding heads, so that fewer or no caddies or peg trays arrive at the more distant winding heads. This also results from the fact that the specific track guide imposes limits on the transport speed of the caddies or peg trays on the distributing stretch.

German Patent DE 38 43 554 A1 discloses a cop delivery apparatus for a winding machine which provides relatively short distributing sections for different yarn batches, each of which sections has its own infeed position for the caddies, peg trays or other cop carriers. The problem of an undersupply in the case of short cop running times does not occur with these short distributing sections.

SUMMARY OF THE INVENTION

It is therefore an object of the present invention to provide an apparatus for delivery of cops mounted upstanding on peg trays or other carriers to the multiple winding heads of an automatic bobbin winding machine which assures a sufficient supply for the entire bobbin winding machine even in the case of short cop running times at the winding heads.

Basically, the present invention provides an improvement in apparatus of the type adapted for delivering textile cops mounted in upstanding disposition on carriers, such as peg trays or caddies, to a plurality of winding heads permanently arranged adjacent to one another on an automatic bobbin winding machine, wherein a cop carrier distributing conveyor defines a cop distributing path extending alongside the winding heads, infeed positions are spaced along the distributing path for feeding cop-mounted carriers thereto, a drive arrangement for the cop carrier conveyor is alternatingly switchable between opposite driving directions, and supply paths extend from the cop carrier conveyor to the winding heads and are symmetrically oriented to the cop carrier conveyor to be capable of receiving cop carriers therefrom independently of their direction of travel on the distributing path.

Briefly summarized, according to the present invention, the distributing path forms a transport section common to all of the winding heads with the infeed positions being spaced such that a first plurality $n_1$ of the winding heads in operation are located to one side of a first one of the infeed positions, a second plurality $n_2$ of the winding heads in operation are located to the opposite side of a second one of the infeed positions, and a third plurality k of the winding heads are located between the first and second infeed positions, with the number of winding heads $n_1$ being greater than or equal to 4, the number of winding heads $n_2$ also being greater than or equal to 4, and the number of winding heads k being less than or equal to the sum of $n_1+n_2+3$.

The arrangement of several infeed positions along the distributing path, which is continuous and thus common to all winding heads, assures that a sufficient supplying of cops is available to the entire bobbin winding machine at all times, including the start of the winding process. Thus, with the infeed positions arranged in accordance with the invention along the distributing path, peg trays, caddies or other carriers arrive at the infeed positions at the same time for transfer onto the transport section of the distributing path which is common to all winding heads. As a result thereof, the paths which the carriers must traverse on this distributing path to reach the winding heads are considerably shortened. It therefore causes no problems to use a low traveling speed for transporting the carriers on the distributing path which promotes a smooth delivery of the carriers to the winding heads.

Moreover, the arrangement of the infeed positions according to this invention assures a sufficiently uniform distribution of the carriers onto the entire distributing path that the number of carriers present on this path on the average can also be minimized while still adequately supplying the winding heads. This effect is also aided by utilizing a higher transport speed in the delivery means by which carriers are fed to the infeed positions in comparison to the cop carrier conveyor belt of the distributing path. In this manner, an unnecessary storage of carriers in the transport system is avoided and the number of carriers circulating altogether in the bobbin winding machine is limited to a minimum.

The control of the direction of travel of the cop carrier conveyor belt is especially effective with the aid of sensors located at the ends of the conveyor belt. Specifically, the drive to the cop carrier conveyor belt preferably utilizes a frequency converter for purposes of switching its drive directions, the sensors being connected to the frequency converter and operable to emit a signal for switching the driving direction of the drive and, in turn, reversing the direction of travel of the cop carrier conveyor belt upon a backup of a plurality of cop carriers. A circuit is additionally provided for actuating the frequency converter after a predetermined time period independently of the signals of the sensors.

Thus, an optimum adaptation of the direction of travel of the cop carrier conveyor belt to the distribution of carriers on the cop carrier conveyor belt is achieved in this manner. Also, the winding heads can thereby be fully supplied by a relatively low number of caddies. The time-controlled circuit serves as a safety measure which is intended to prevent an unnecessary displacement or shifting of the carriers to one end of the transport section.

In the preferred embodiment, a main delivery conveyor and secondary delivery conveyors branching therefrom are provided for delivery of the cop carriers to the cop carrier distributing conveyor belt, with the infeed positions being located at the ends of the secondary delivery conveyors. A sensor and a shunt are located at at least one of the secondary delivery conveyors for controlling uniform distribution of the cop carriers to the infeed positions.

It is considered especially advantageous for a high delivery capacity of cop-mounted carriers to the infeed positions and to the distributing path to provide cop preparation devices at the secondary branch delivery conveyors located between the common main delivery conveyor and the infeed positions. This arrangement eliminates any bottleneck in the cop delivery capacity which can be produced by the provision of only one cop preparation device for the entire bobbin winding machine.

The preferred embodiments of the present invention contemplate relatively specific arrangements of the infeed positions in accordance with the number of winding heads of the bobbin winding machine. The winding machine should preferably comprise two to six winding sections each having the same number of winding heads, e.g., ten winding heads per section in a preferred embodiment. In bobbin winding machines wherein the winding heads comprise two winding sections, one infeed position is located centrally within a first one of the winding sections. Where the winding machine comprises three sections of winding heads, an infeed position is located centrally within each of first and second ones of the winding sections. Winding machines comprising four winding head sections preferably have infeed positions located centrally within each of first and third ones of the winding sections. In winding machines having five winding sections of winding heads, infeed positions are located centrally within first, second and fourth ones of the winding sections. Winding machines having six sections of winding heads preferably have infeed positions located centrally within each of first, third and fifth ones of the winding sections. In embodiments wherein each winding section comprises ten winding heads, each infeed position is located between two winding heads in the area between a fifth and an eighth one of the winding heads within its respective winding section.

DESCRIPTION OF THE PREFERRED EMBODIMENT

Figure 3:
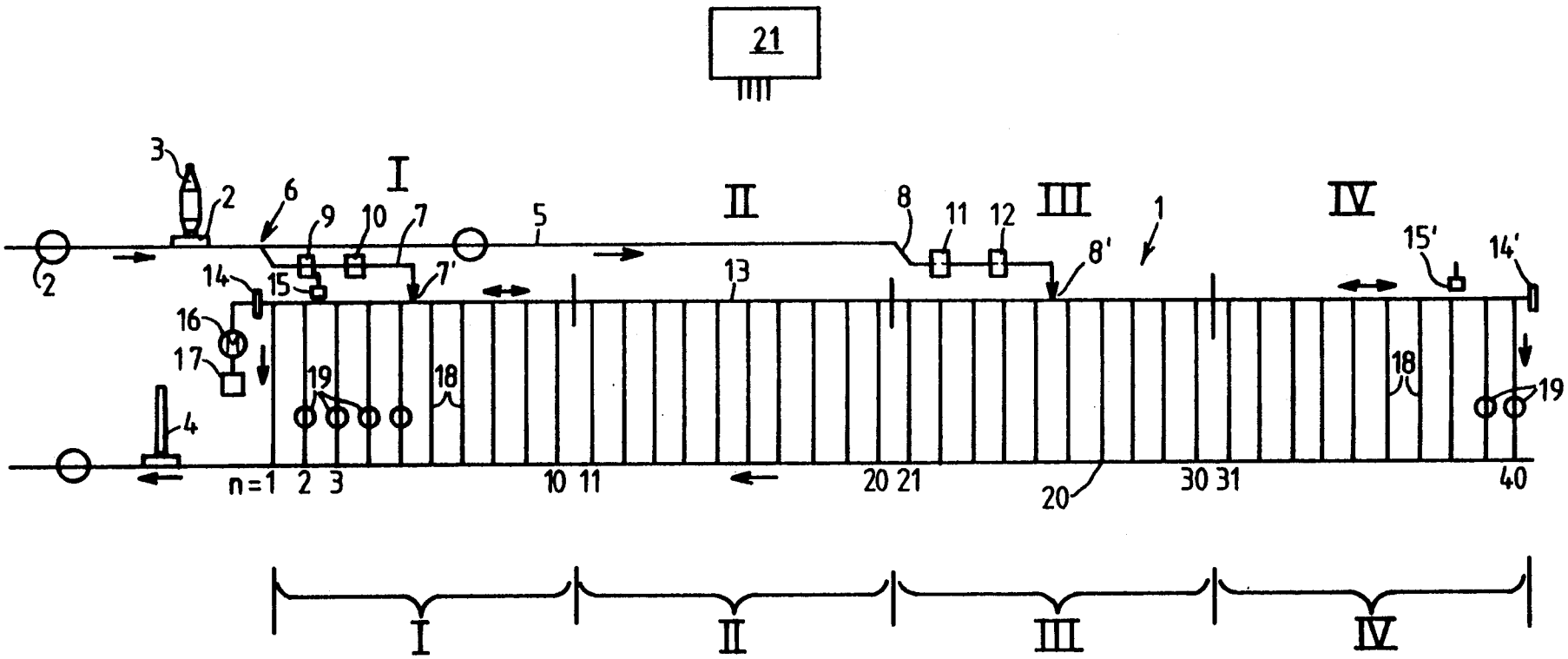

Referring now to FIG. 3 of the accompanying drawings, a bobbin winding machine is shown generally at 1 and comprises a closed conveyor circuit for transporting cop caddies 2 on which cops 3 are mountable in upstanding disposition. The cop transport paths located at the head end of the bobbin winding machine 1 are not shown since they have no significance with respect to the present invention. Their design is well known from German Patent DE 39 19 542 A1. For reasons of clarity, only a representative few of the caddies or peg trays 2 are illustrated. The bobbin winding machine 1 is itself of a substantially conventional construction, having a plurality of winding stations or heads 19 arranged permanently on a machine frame in spaced alignment adjacent one another lengthwise along the machine, as representatively indicated in the drawing. In the illustrated embodiment of FIG. 3, the winding machine 1 is provided with a total of forty winding stations or heads 19 arranged in four winding sections I,II,III,IV, each comprised of ten successive winding heads, winding section I including winding head numbers 1 through 10, winding section II including winding head numbers 11 through 20, winding section III including winding head numbers 21 through 30, and winding section IV including winding head numbers 31 through 40.

A common delivery conveyor 5 for all caddies or peg trays 2 carrying cops 3 extends over a large lengthwise portion of bobbin winding machine 1. Secondary conveyor paths 7 and 8 branch from the common conveyor 5. The branch secondary conveyor paths 7 and 8 discharge at infeed positions 7' and 8' into a distributing path 13 which extends lengthwise along the winding machine.

A shunt 6, indicated only representatively by an arrow, is provided at the beginning of the branch conveyor 7. This shunt 6 is connected in front of a sensor (not shown) which detects the passage of a caddy 2 and signals this passage to a central control unit 21 which includes a control connection to the shunt 6. This sensor/shunt combination assures that arriving caddies 2 are shunted off in a predeterminable number to the branch conveyor 7 or are permitted to continue travel on the delivery conveyor 5 to the other branch secondary conveyor 8. The branch secondary conveyor paths 7 and 8 discharge at infeed positions 7' and 8' into a distributing path 13 which extends lengthwise along the winding machine.

In the illustrated embodiment of FIG. 3 utilizing two infeed positions 7' and 8', it will be understood that the caddies 2 transported along the delivery conveyor 5 must be divided in equal number between these two infeed positions 7',8'. Consequently, the shunt 6 can be controlled by the central control unit 21 in such a manner that it permits every second cop-mounted caddy 2 to pass the shunt 6 to travel to the branch conveyor 8 while diverting every intervening caddy 2 to the branch conveyor 7. It is of course equally possible to shunt a large group of successive caddies 2 to the branch conveyor 7 and then alternately to permit a succeeding group of a corresponding number of successive caddies 2 to pass to the branch conveyor 8. This procedure reduces the necessity of having to repetitively switch the shunt 6.

If more than two infeed positions are utilized, the corresponding division of caddies must be adapted to the number of infeed positions. For example, in the case of three infeed positions, sensor/shunt combinations would be required at the junction of the main delivery conveyor 5 with two of the branch conveyors. The shunt located first in the direction of transport on the delivery conveyor 5 would direct every third caddy 2 or every third group of a predetermined number of successive caddies 2 into the corresponding branch conveyor and permit all other caddies to pass downstream along the delivery conveyor 5. Of such caddies 2 passing the first shunt, an equal division would be carried out at the second sensor/shunt combination.

Cop preparation units 9,10,11,12 are located in pairs along the branch conveyor paths 7 and 8. Each two cop preparation units 9,10 and 11,12 perform different preparation steps, as is described e.g. in German Patent DE 39 19 526 A1.

Distributing path 13 comprises a cop carrier conveyor belt (not shown separately) which, as is indicated by directional arrows, can be driven in alternating fashion in opposite directions. To this end, a drive motor 16 is connected to a frequency converter 17 which is regulated by the central control unit 21. Barriers 14 and 14' are located at the opposite ends of the distributing path 13 of the conveyor belt to define therebetween a transport section along which the caddies 2 travel. Sensors 15 and 15' are respectively located at a spacing from the barriers 14,14' which corresponds to the space occupied along the belt by a backup of a predetermined number of caddies, e.g. three caddies.

If either of these sensors 15 and 15' recognize that an adjacent caddy on the distributing path 13 is no longer being transported by the conveyor belt, thereby indicating that at least three caddies 2 are backed up at the particular barrier 14,14' a corresponding signal is transmitted to the central control unit 21. The central control unit 21 then actuates the frequency converter 17 to cause a reversal of the direction of drive rotation of the motor 16 and therewith a reversal of the direction of travel of the cop carrier conveyor belt along the distributing path 13.

The directional changes in travel of the cop carrier conveyor belt which thereby result, in conjunction with the described arrangement of the infeed positions 7',8' for the caddies 2, assure a sufficient uniform supply of cops 3 to all the winding heads 19 of the winding machine 1.

Each winding head 19 of the winding machine 1 is equipped with a supply path 18 extending transversely between the winding head 19 and the distributing path 13, each supply path providing two or three reserve positions for cop-mounted caddies 2 awaiting delivery to the winding head 19. Supply paths 18 from the distributing path 13 are symmetrically designed in a known manner in order to be able to receive caddies 2 from the distributing path conveyor belt independently of their direction of travel along the distributing path 13.

A return conveyor belt 20 extends lengthwise along the winding machine 1 at the ends of the transverse supply paths 18 at the opposite side of the machine from the distributing path 13 to transport caddies 2 discharged from the winding heads 19 with unwound tubes 4 to a tube removal device (not shown).

A timing circuit is provided in the central control unit to control switching actuation of the frequency converter 17 at predetermined time intervals independently of the signals of the sensors 15,15'. The set time span is selected to be sufficiently great that in the normal instance the switching of the frequency converter 17 due to the signals of sensors 15,15' occurs before this time span has elapsed. This circuit is basically intended only as a safety circuit so that in the exceptional case of a backup or accumulation of caddies 2 at one end of the distributing path 13, the caddies can be redistributed along the distributing path 13 and an undersupplying of the winding heads located at the other end of the transport section of the distributing path is avoided.

Figure 1:
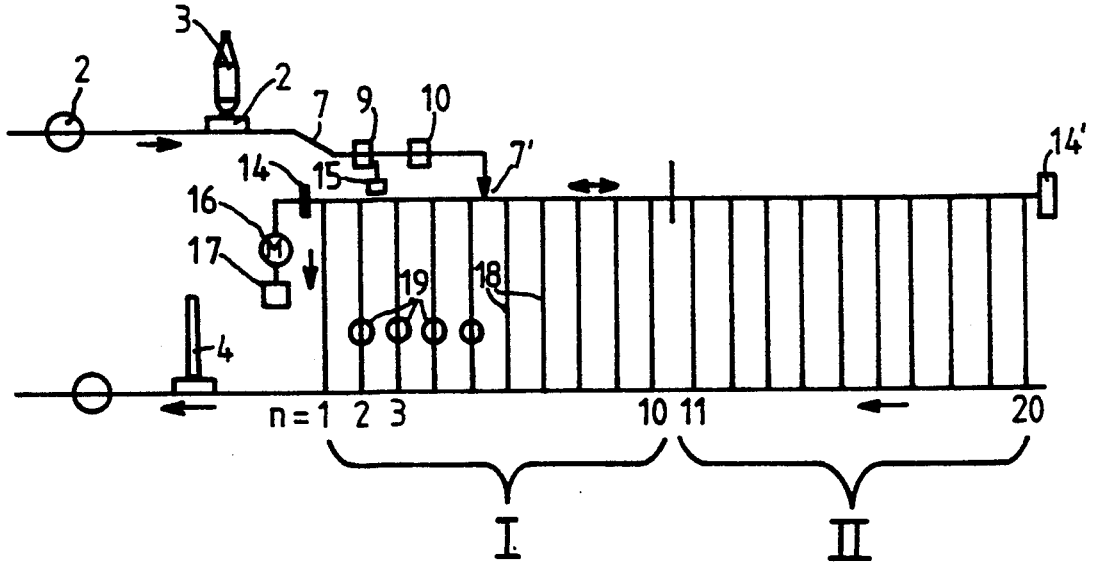
FIGS. 1-5 show schematic plan views of bobbin winding machines equipped with a cop delivery apparatus according to five preferred embodiments of the present invention.
Figure 2:
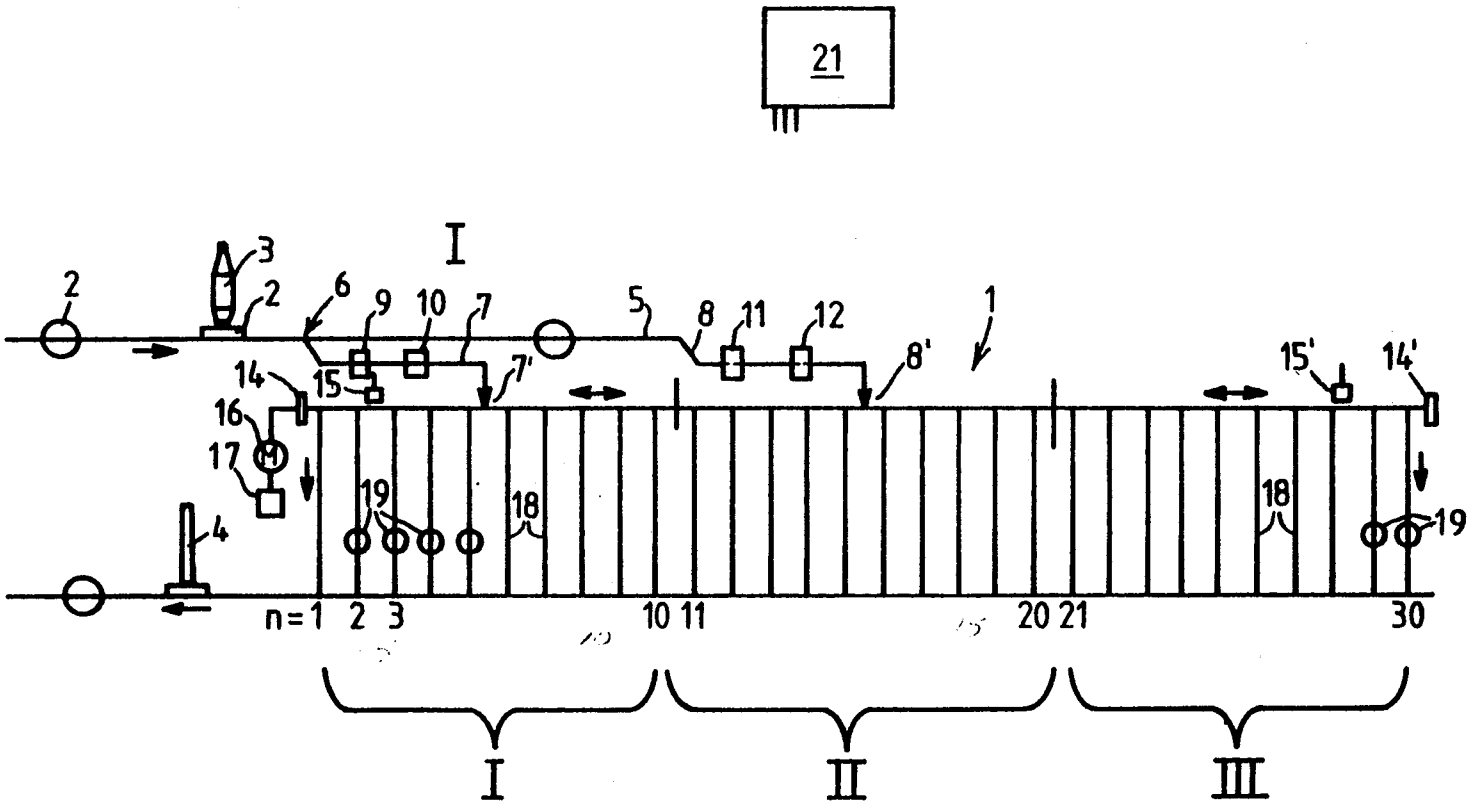
Figure 4:
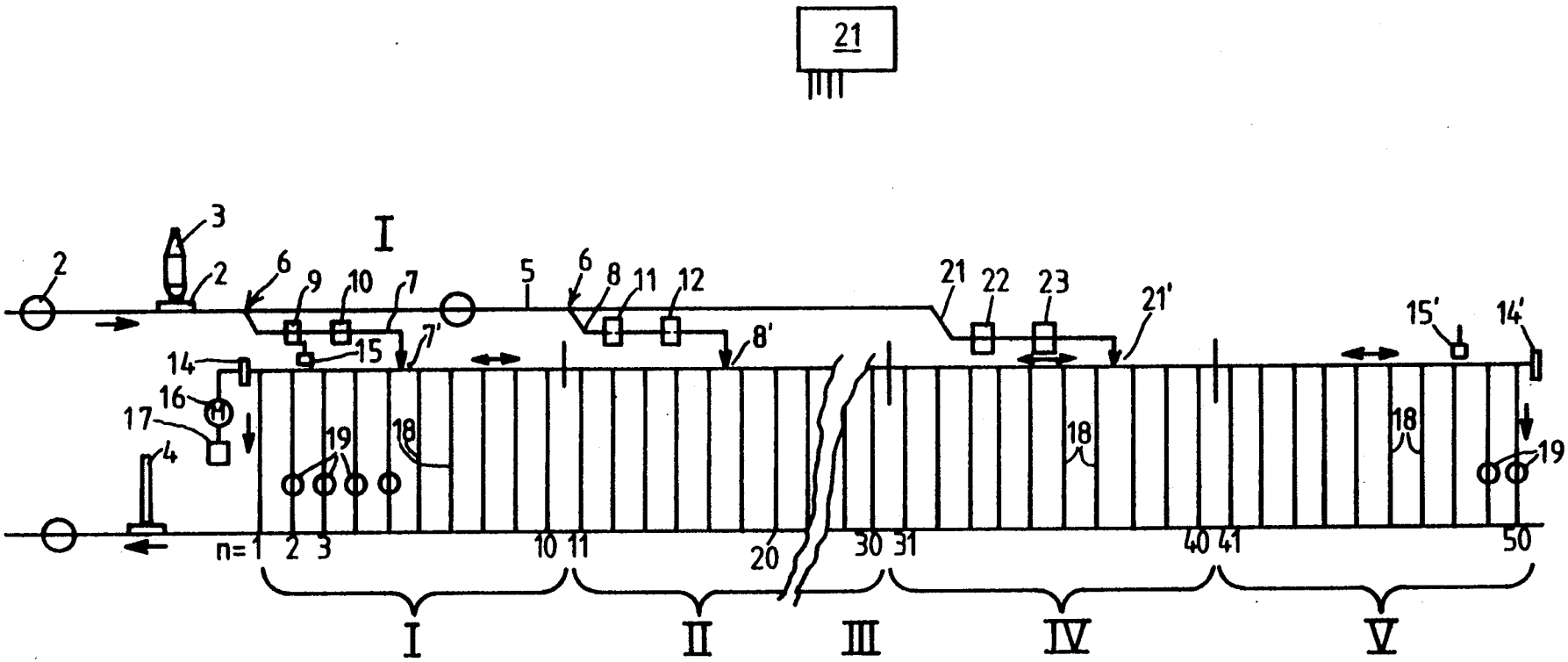
Figure 5:
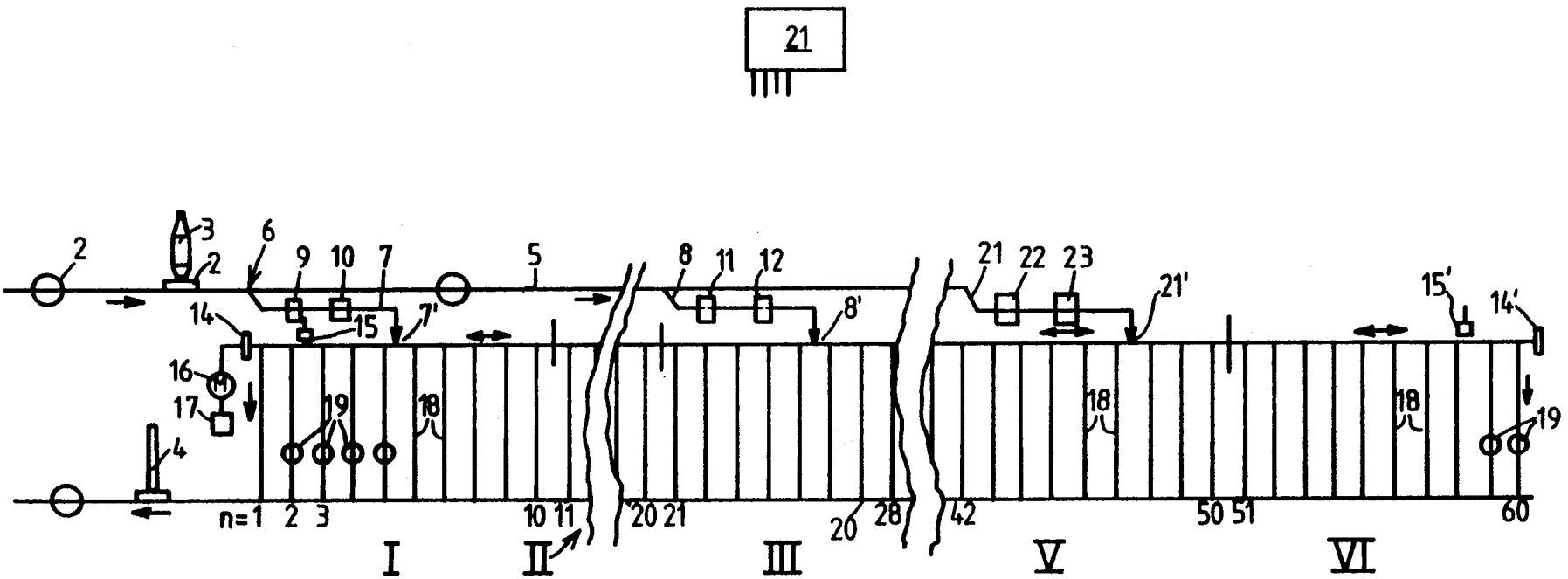

The following spacings and arrangements of infeed positions in differing embodiments of differing numbers of winding sections, including by way of example the four winding sections I,II,III,IV illustrated in FIG. 3 are considered especially advantageous according to the present invention:

| | |
|---|---|
| FIG. 1: Two winding sections I and II: | One infeed position 7' in the first section (I); |
| FIG. 2: Three winding sections I, II, and III: | One infeed position 7', 8' in each of the first and second sections (I, II); |
| FIG. 3: Four winding sections I–IV: | One infeed position 7', 8' in each of the first and third sections (I, III); |
| FIG. 4: Five winding sections I–V: | One infeed position 7', 8', 21' in each of the first, second and fourth sections (I, II, IV); and |
| FIG. 5: Six winding sections I–VI: | One infeed position 7', 8', 21' in each of the first, third and fifth sections (I, III, V). |

In each embodiment, each of the infeed positions is located in the middle area of its respective section, i.e., centrally along the lengthwise extend of the section, and in each case, each infeed position is disposed between two adjacent winding heads. Within the sections, the particular infeed positions 7', 8' and 21' are directly in the lengthwise center of middle of each section, i.e., between the fifth and the sixth winding head of the ten winding heads of the section.

The transport of caddies 2 mounted with cops 3 to the winding heads of the bobbin winding machine which are located furthest from the position at which the caddies are delivered to the bobbin winding machine takes place at a considerably faster traveling speed on the delivery conveyor 5 than is possible on the distributing path 13. For example, the transport speed of the cop carrier conveyor belt at 5 m/min. is only one third as great as on delivery conveyor 5 whose relative speed would be 15 m/min. A rapid supply of cops 3 is assured in this manner without a high speed of the cop carrier conveyor belt being necessary along its distributing path 13. Rather, the cop carrier conveyor belt can run at a speed which constantly assures a reliable delivery of the caddies 2 into transverse supply paths 18. Moreover, due to its higher transport speed, the delivery conveyor 5 functions only to a slight extent as a cop storage stretch. As a result, the number of the caddies 2 necessary at any given time to maintain a sufficient supplying of cops to the winding heads can be kept low.

The above described disposition of the infeed positions 7' and 8' in conjunction with the cyclical reversing of the cop carrier conveyor belt achieves a sufficient supply of cops 3 to the winding heads both at the opposite ends of the winding machine 1 and in the central area of the winding machine 1 without requiring a substantial number of cop-mounted caddies 2 to be maintained on the distributing path 13. This arrangement also reduces the number of caddies 2 required in relation to the number of winding heads.

The advantages of the present invention are especially apparent when the winding machine is processing relatively small-sized cops which require relatively short rewinding times. Such small cops are increasingly utilized under current practices in the textile industry with the purpose of raising the output of ring spinning machines. The rewinding times required for such cops may typically be between one and two minutes.

The present invention has the distinct advantage over known cop delivery apparatus that, at the start of a batch winding operation, all of the winding heads of the machine can begin operation within a very short time. It is therefore basically unimportant if all of the storage positions on the supply paths 18 between the distributing path 13 and the winding heads 19 are not initially filled.

In the case of known apparatus whose cop distributing paths have an infeed location at one end, the winding heads located at such infeed end all become completely supplied with cops at first before it becomes possible for cops to reach the winding heads located further downstream along the distributing path. The winding heads located nearest the infeed end of the distributing path continually take cop-mounted caddies from the distributing path as the winding operation progresses, as soon as a cop replacement has taken place. In contrast thereto, in the case of the delivery apparatus of the present invention all of the winding heads of the entire bobbin winding machine are in operation relatively shortly after the start of a batch since a uniform distribution of the caddies takes place. In addition, on account of preparation stations 9,10,11,12 on the branch delivery conveyors 7,8, the supply of the distributing path 13 with caddies can occur twice as fast and in the case of three infeed positions up to three times as fast by virtue of the fact that these preparation units can operate simultaneously. On the other hand, the delivery of cop-mounted caddies 2 to the preparation stations can take place considerably more rapidly than the preparation operation itself. Even the delivery of cops to the bobbin winding machine can be accomplished with a very high capacity, as is described e.g. in German Patent Application No. P 41 12 435.9. The cop placing performance achieved in the apparatus of this publication considerably exceeds the operating capacity of a single cop preparation device.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an apparatus for delivering cops mounted upstanding on carriers to a plurality of winding heads permanently arranged adjacent to each other on an automatic bobbin winding machine, said apparatus comprising a cop carrier distributing conveyor defining a cop distributing path extending alongside said winding heads, infeed positions spaced along said distributing path for feeding cop-mounted carriers thereto, drive means for said cop carrier conveyor, said drive means being alternatingly switchable between opposite driving directions, and supply paths extending from said cop carrier conveyor to said winding heads, said supply paths being oriented to said cop carrier conveyor to be capable of receiving cop carriers therefrom independently of their direction of travel on said distributing path, the improvement comprising said distributing path forming a transport section common to all said winding heads with said infeed positions being spaced such that a first plurality $n_1$ of said winding heads in operation are located to one side of a first one of said infeed positions, a second plurality $n_2$ of said winding heads in operation are located to the opposite side of a second one of said infeed positions and a third plurality k of said winding heads in operation are located between said first and second infeed positions, wherein $n_1 \geqq 4$, $n_2 \geqq 4$ and $k \leqq n_1 + n_2 + 3$.

2. The cop delivery apparatus according to claim 1, wherein said drive means includes a frequency converter, and further comprising sensors located at the ends of said cop carrier conveyor, said sensors being connected to said frequency converter and operable to emit a signal for switching the driving direction of said drive means for reversing the direction of travel of said cop carrier conveyor upon a backup thereon of a plurality of said cop carriers.

3. The cop delivery apparatus according to claim 2, and further comprising a circuit for actuating the frequency converter after a predetermined time period independently of the signals of said sensors.

4. The cop delivery apparatus according to claim 1, and further comprising a main delivery conveyor and secondary delivery conveyors branching therefrom for delivery of cop carriers to said cop carrier distributing conveyor, said infeed positions being located at the ends of said secondary delivery conveyors, and a sensor and a shunt being located at at least one said secondary delivery conveyor for controlling uniform distribution of cop carriers to said infeed positions.

5. The cop delivery apparatus according to claim 4, and further comprising cop preparation devices located at said secondary delivery conveyors.

6. The cop delivery apparatus according to claim 1, wherein said bobbin winding machine comprises two winding sections, each of which comprises the same number of winding heads, and wherein one of said infeed positions is located centrally within a first one of said winding sections.

7. The cop delivery apparatus according to claim 1, wherein said bobbin winding machine comprises three winding sections, each of which comprises the same number of winding heads, and wherein one of said infeed positions is located centrally within each of first and second ones of said winding sections.

8. The cop delivery apparatus according to claim 1, wherein said bobbin winding machine comprises four winding sections, each of which comprises the same number of winding heads, and wherein one of said infeed positions is located centrally within each of first and third ones of said winding sections.

9. The cop delivery apparatus according to claim 1, wherein said bobbin winding machine comprises five winding sections, each of which comprises the same number of winding heads, and wherein one of said infeed positions is located centrally within each of first, second and fourth ones of said winding sections.

10. The cop delivery apparatus according to claim 1, wherein said bobbin winding machine comprises six winding sections, each of which comprises the same number of winding heads, and wherein one of said infeed positions is located centrally within each of first, third and fifth ones of said winding sections.

11. The delivery device according to one of claims 6, 7, 8, 9 or 10, wherein each said winding section comprises ten winding heads and each infeed position is located between two winding heads in the area between a fifth and an eighth one of said winding heads within its respective winding section.

12. In an apparatus for delivering cops mounted upstanding on carriers to a plurality of winding heads permanently arranged adjacent to each other on an automatic bobbin winding machine, said apparatus comprising a cop carrier distributing conveyor defining a cop distributing path extending alongside said winding heads, at least one infeed position located along said distributing path for feeding cop-mounted carriers thereto, drive means for said cop carrier conveyor, said drive means being alternatingly switchable between opposite driving directions, and supply paths extending from said cop carrier conveyor to said winding heads, said supply paths being oriented to said cop carrier conveyor to be capable of receiving cop carriers therefrom independently of their direction of travel on said distributing path, the improvement comprising said winding machine having at least two winding sections each comprising the same number of winding heads, said distributing path forming a transport section common to all said winding heads with said one infeed position being located centrally within a first one of said winding sections such that a first plurality $n_1$ of said winding heads in operation are located to one side of said one infeed position and a second plurality $n_2$ of said winding heads in operation are located to the opposite side of said one infeed position, wherein $n_1 \geqq 4$ and $n_2 \geqq n^1$.

* * * * *